US008102322B2

(12) United States Patent
Khreizat et al.

(10) Patent No.: US 8,102,322 B2
(45) Date of Patent: Jan. 24, 2012

(54) VEHICLE ANTENNA ASSEMBLY

(75) Inventors: Salman Khreizat, Dearborn, MI (US); Christopher Matthews, Farmington Hills, MI (US)

(73) Assignee: Nissan North America, Inc., Franklin, TN (US)

( * ) Notice: Subject to any disclaimer, the term of this patent is extended or adjusted under 35 U.S.C. 154(b) by 478 days.

(21) Appl. No.: 12/394,378

(22) Filed: Feb. 27, 2009

(65) Prior Publication Data

US 2010/0220021 A1 Sep. 2, 2010

(51) Int. Cl.
*H01Q 1/32* (2006.01)

(52) U.S. Cl. ..... 343/715; 343/711; 343/713

(58) Field of Classification Search ..... 343/888, 343/892, 711–717
See application file for complete search history.

(56) References Cited

U.S. PATENT DOCUMENTS 2,269,947 A 10/1939 Ludwig
4,107,694 A 8/1978 Morgan et al.
4,151,533 A * 4/1979 Vogt ..... 343/715
4,194,208 A * 3/1980 Eveloff ..... 343/715
4,431,332 A 2/1984 Dieges
5,233,363 A 8/1993 Yarsunas et al.
5,583,522 A * 12/1996 Radomski et al. ..... 343/715
6,157,345 A 12/2000 Hockett et al.
6,236,377 B1 5/2001 Hussaini et al.
6,243,044 B1 6/2001 Scott

* cited by examiner

*Primary Examiner* — Jacob Y Choi
*Assistant Examiner* — Amal Patel
(74) *Attorney, Agent, or Firm* — Global IP Counselors, LLP

(57) ABSTRACT

A vehicle antenna assembly is provided with an antenna and a mounting bracket. The antenna includes an elongated mast section and a base section. The mounting bracket includes a first end with an antenna attachment section fixed to the base section of the antenna, a middle section extending downwardly from the antenna attachment section, and a second end with a vehicle attachment section extending from the middle section in a radial direction with respect to a center longitudinal axis of the elongated mast section as viewed along the center longitudinal axis of the elongated mast section. The middle section includes a fulcrum point arranged to engage a portion of the vehicle for pivoting the mounting bracket about the fulcrum point to move the vehicle facing support surface towards the vehicle.

20 Claims, 12 Drawing Sheets

VEHICLE ANTENNA ASSEMBLY

BACKGROUND OF THE INVENTION

1. Field of the Invention

The present invention generally relates to an antenna assembly. More specifically, the present invention relates to an antenna mounting structure for mounting an antenna in an area with tight clearances around the base of the antenna.

2. Background Information

Most automotive vehicles are equipped with a radio, which typically requires an antenna to effectively receive radio waves. In the past, most automotive vehicles included an externally mounted antenna. The most common vehicle antenna is a mast or thin rod type antenna that extends upwardly from a body panel such as a rear quarter panel, a front fender, or an A-pillar. In some vehicle designs, it can be difficult to install the mast type antenna in a desired location. In particular, typically, a hand insertion clearance of at least a one hundred millimeter sphere is desired to install the mast type antenna. Since the antenna mounting structure is normally located beneath the body panel, the hand insertion clearance beneath the antenna opening in the body panel can often be less than the desired hundred millimeter sphere. In such cases, the mast type antenna has been replaced with other styles of antennas. However, the mast type antenna tends to be one of the most economical types of antennas available.

In view of the above, it will be apparent to those skilled in the art from this disclosure that there exists a need for an improved antenna assembly. This invention addresses this need in the art as well as other needs, which will become apparent to those skilled in the art from this disclosure.

SUMMARY OF THE INVENTION

In view of the state of the known technology, one aspect of the present invention is to provide an antenna assembly with a mounting structure that permits an antenna to be mounted in an area with tight clearances around the base of the antenna.

In accordance with the above mentioned aspect, a vehicle antenna assembly is provided that basically comprising an antenna and a mounting bracket. The antenna includes an elongated mast section and a base section. The mounting bracket includes a first end with an antenna attachment section fixed to the base section of the antenna, a middle section extending downwardly from the antenna attachment section, and a second end with a vehicle attachment section extending from the middle section in a radial direction with respect to a center longitudinal axis of the elongated mast section as viewed along the center longitudinal axis of the elongated mast section. The vehicle attachment section has a vehicle facing support surface defining a vehicle attachment plane with the vehicle facing support surface having a fastening part configured and arranged to be fastened to a vehicle such that the base section of the antenna is supported by the antenna attachment section above the vehicle attachment plane. At least one of the middle section and the vehicle attachment section includes a fulcrum point arranged to engage a portion of the vehicle for pivoting the mounting bracket about the fulcrum point to move the vehicle facing support surface towards the vehicle.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Figure 1:
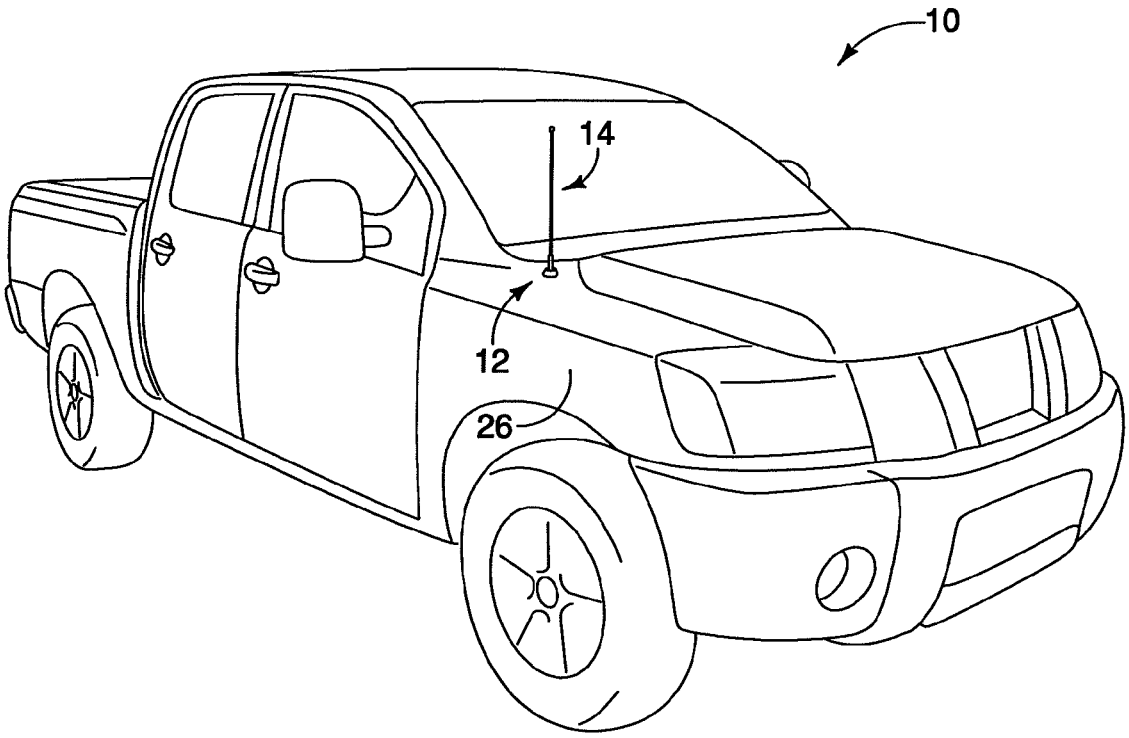
FIG. 1 is a perspective view of a vehicle that is equipped with a vehicle antenna assembly in accordance with one embodiment.
Figure 2:
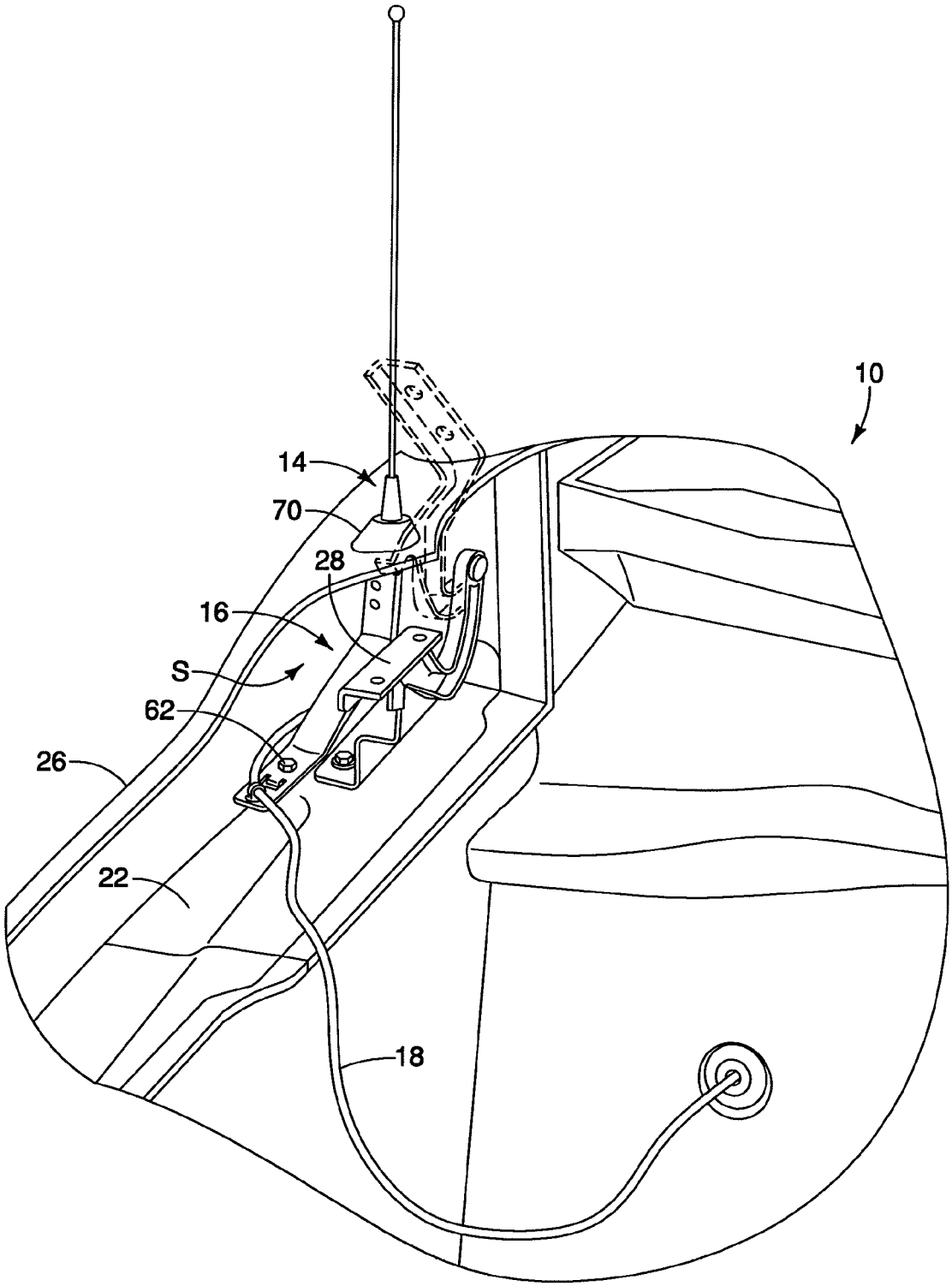
FIG. 2 is a perspective view of the vehicle illustrated in FIG. 1 with the hood removed to show the mounting of the vehicle antenna assembly to the vehicle body.
Figure 3:
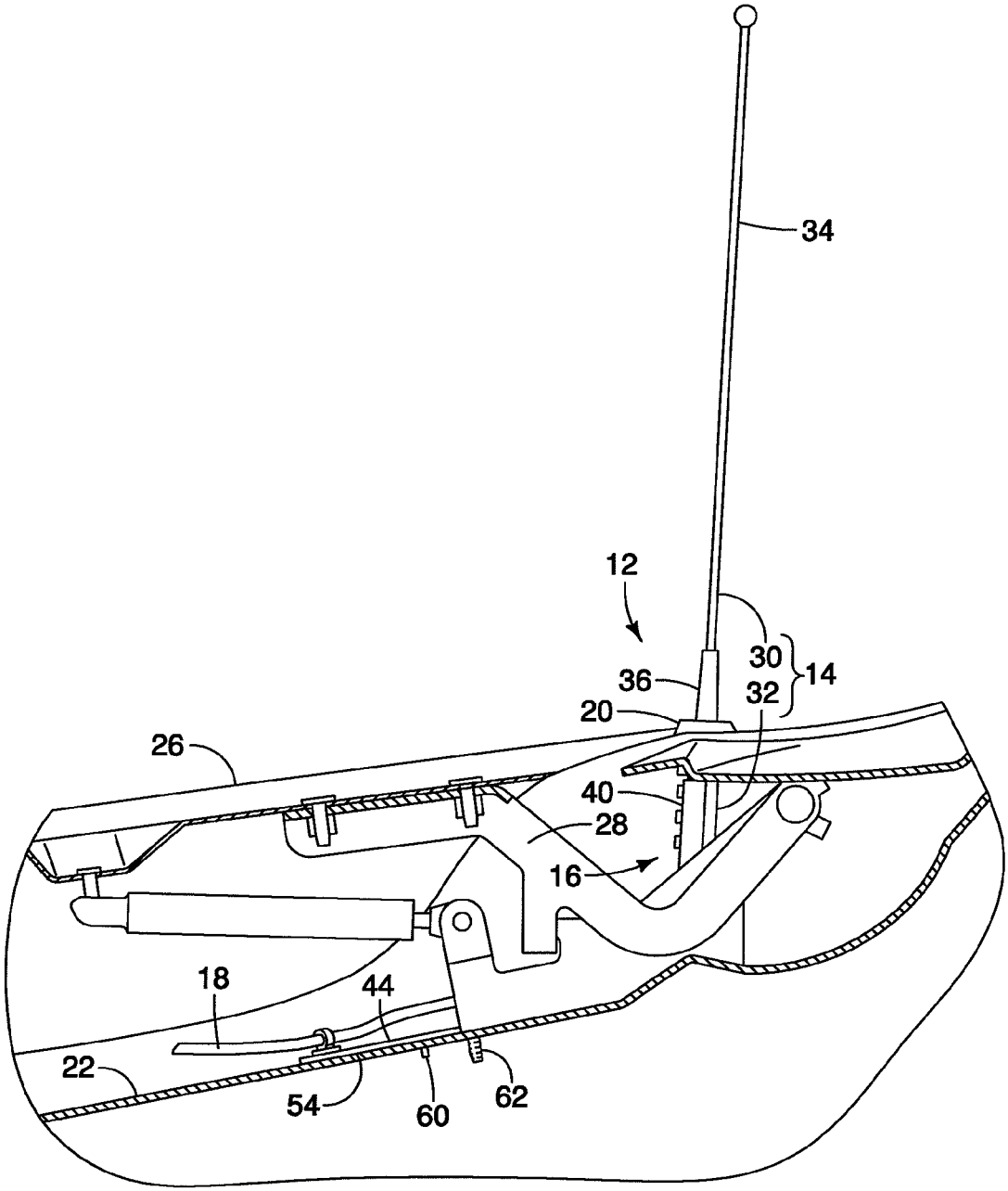
FIG. 3 is a cross sectional view of the vehicle illustrated in FIG. 1 as taken along a longitudinal section to show the vehicle antenna assembly mounted to the vehicle body.
Figure 4:
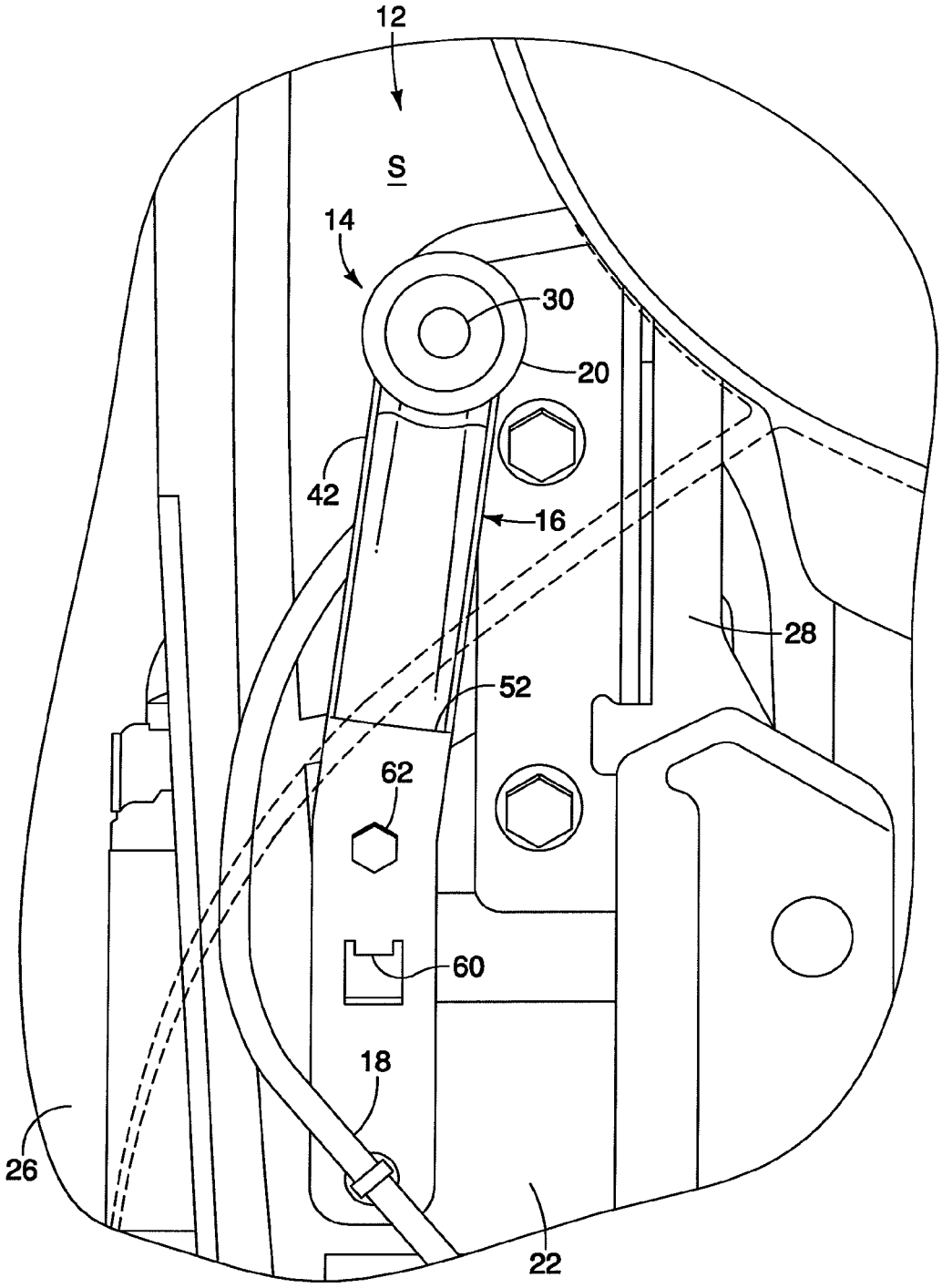
FIG. 4 is a top plan view of the front fender area of the vehicle illustrated in FIG. 1 with the front fender and the hood shown in dotted lines to show the vehicle antenna assembly mounted to the vehicle body.

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

Referring initially to FIGS. 1 to 6, a vehicle 10 is illustrated that is equipped with a vehicle antenna assembly 12 in accordance with one embodiment. The vehicle antenna assembly 12 basically includes an antenna 14, a mounting bracket 16, an antenna (coaxial) cable 18 and a removable grommet 20. Basically, in the illustrated embodiment, the mounting bracket 16 of the vehicle antenna assembly 12 is installed on a hood ledge 22 of the vehicle 10 such that the antenna 14 projects through an antenna opening 24 (shown in FIGS. 12-17) defined by a front fender 26 (e.g., a body panel) of the vehicle 10. Thus, in the illustrated embodiment, the antenna 14 of the vehicle antenna assembly 12 is installed in a tight space S defined by the hood ledge 22, the front fender 26 and a hood hinge 28. This space S is smaller than a minimum hand insertion clearance criteria (i.e., the space S directly beneath the antenna opening 24 in the front fender 26 is less than a hundred millimeter sphere as viewed in a vertical direction). Moreover, in the illustrated embodiment, access through a frontal area between the hood ledge 22, the front fender 26 and the hood hinge 28 to the space S is less than a hundred millimeter sphere.

Figure 6:
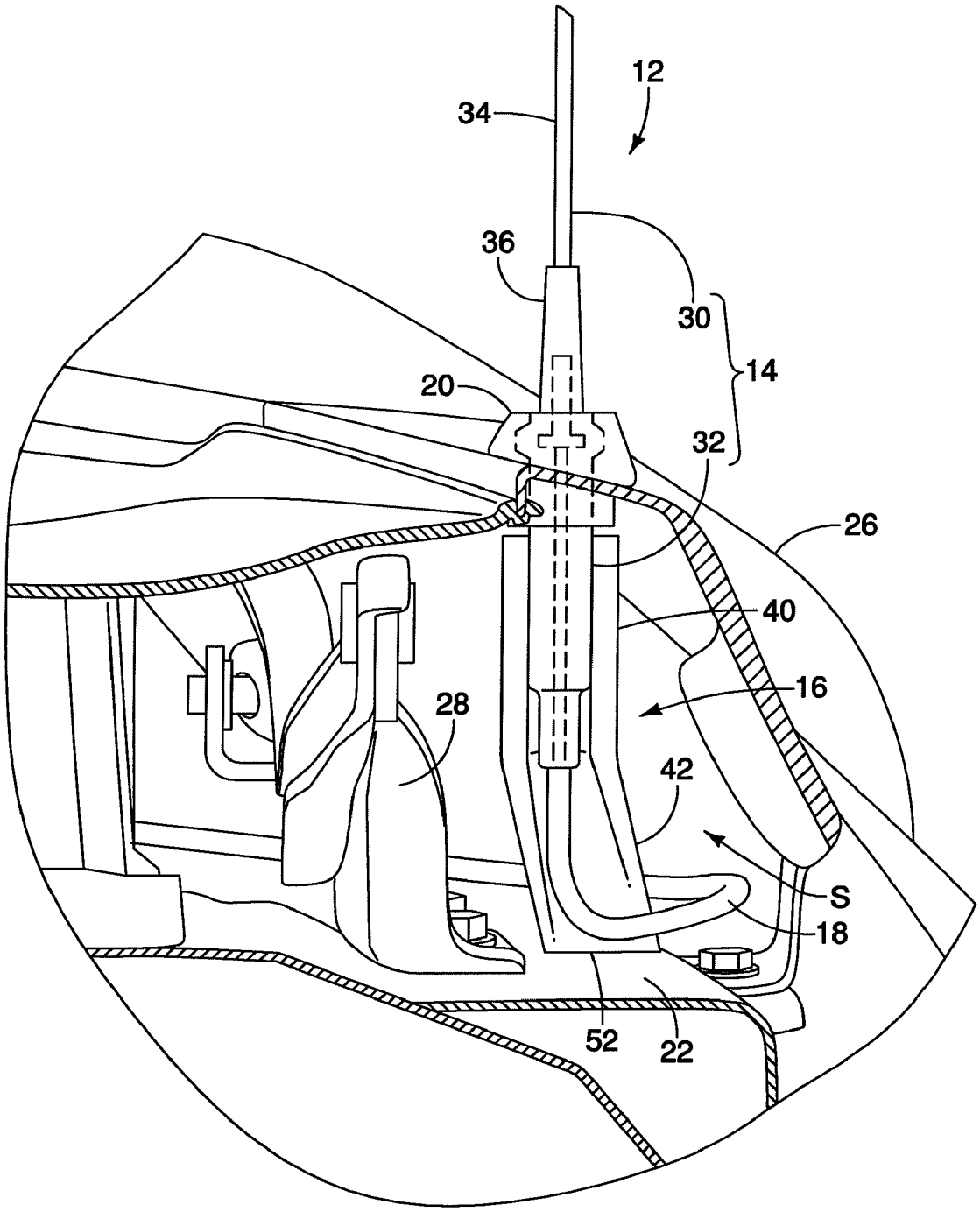
FIG. 6 is a cross sectional view of the vehicle illustrated in FIG. 1 as taken along a transverse section that is looking towards the front of the vehicle to show the vehicle antenna assembly mounted to the vehicle body.
Figure 7:
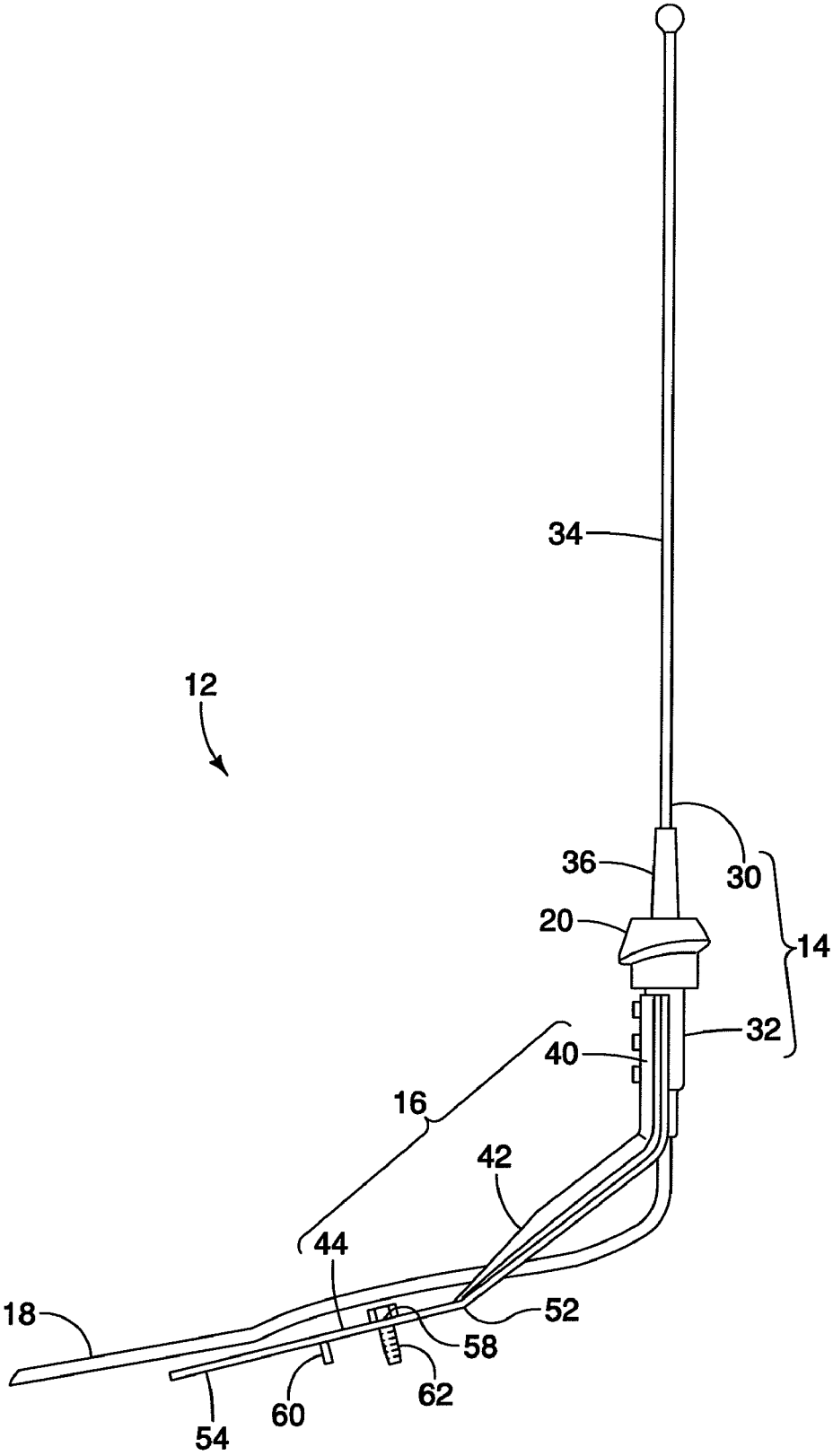
FIG. 7 is a lateral side elevational view of the vehicle antenna assembly by itself.
Figure 8:
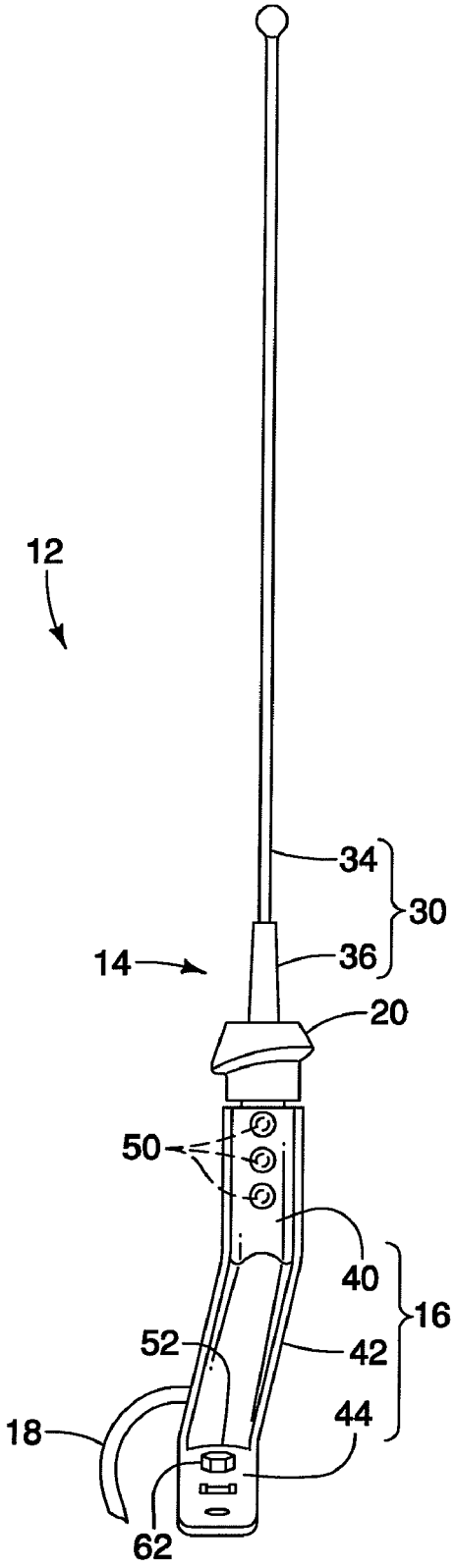
FIG. 8 is a front side elevational view of the vehicle antenna assembly illustrated in FIG. 7.
Figure 9:
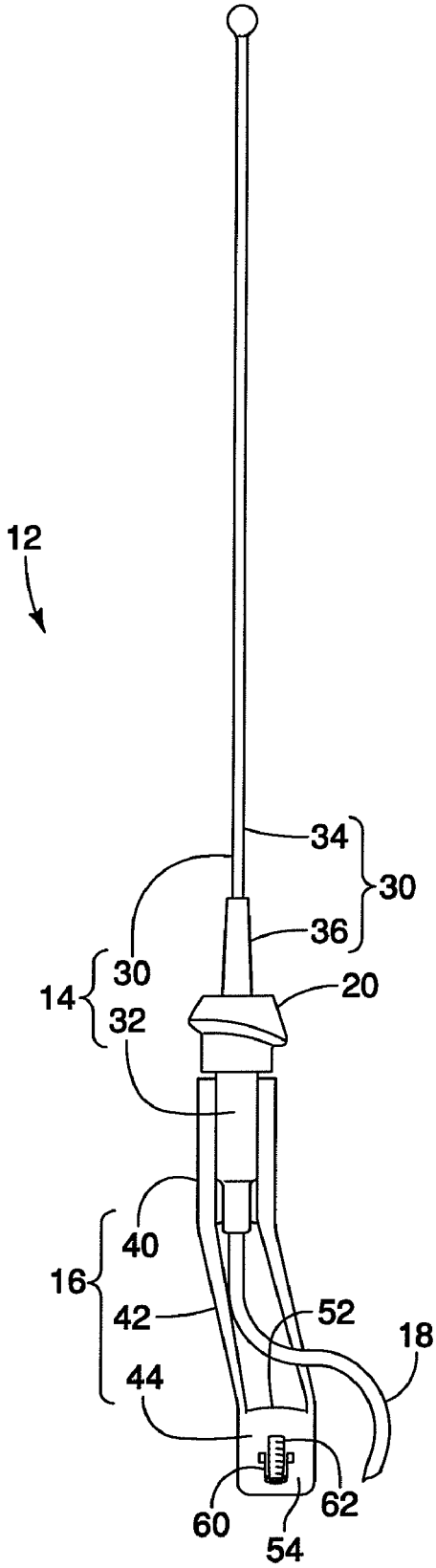
FIG. 9 is a rear side elevational view of the vehicle antenna assembly illustrated in FIGS. 7 and 8.
Figure 10:
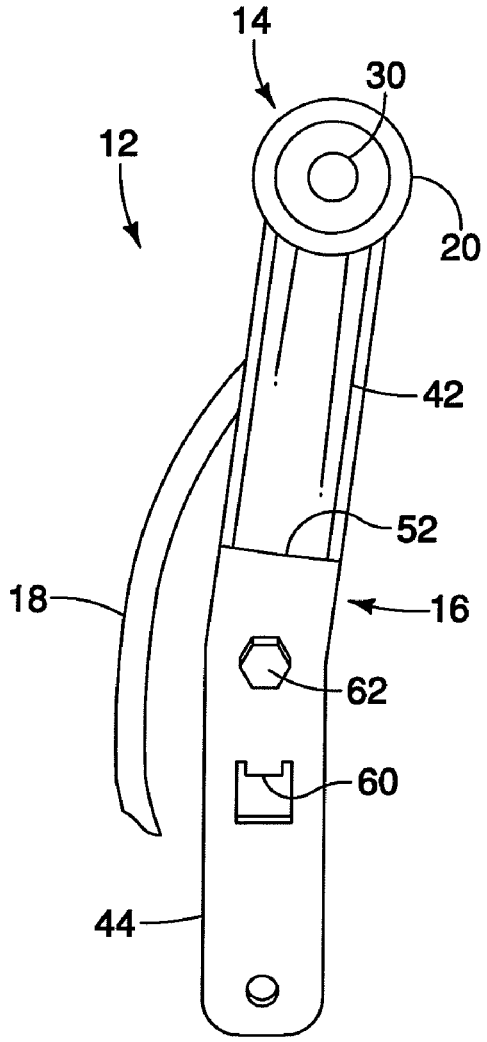
FIG. 10 is a top plan view of the vehicle antenna assembly illustrated in FIGS. 7 to 9.

As seen in FIG. 6, the antenna 14 includes an elongated mast section 30 and a base section 32. The elongated mast section 30 has a solid metal rod 34 with an attachment nut 36 at its lower end. The base section 32 includes a mast attachment screw 38 that threadedly receives the attachment nut 36. Thus, the elongated mast section 30 is removably attached to the mast attachment screw 38 of the base section 32 by the attachment nut 36 of the antenna 14. In other words, the elongated mast section 30 is threadedly attached to the base section 32 by the attachment nut 36 and the mast attachment screw 38 as seen in FIG. 6.

In the illustrated embodiment, the base section 32 of the antenna 14 is a hard rubber member that constitutes an outer molded part, which is molded about a lower portion of the mast attachment screw 38 and one end of the antenna (coaxial) cable 18. The antenna (coaxial) cable 18 constitutes an electrical wire that extends axially from the center of a lower end of the base section 32. As discussed below, the outer molded part of the base section 32 is also partially molded to the mounting bracket 16 to secure the mounting bracket 16 to the base section 32 of the antenna 14.

When the vehicle antenna assembly 12 is installed to the hood ledge 22 of the vehicle 10, an upper end of the base section 32 is disposed within the opening 24 (FIGS. 14 and 17) defined by the front fender 26 of the vehicle 10 with the grommet 20 disposed about the upper end of the base section 32 to seal the gap between the upper end of the base section 32 and the front fender 26. Also in the installed position, the mast attachment screw 38 of the base section 32 is disposed above the front fender 26 of the vehicle 10 (see FIGS. 14 and 17) so that the elongated mast section 30 of the antenna 14 can be easily attached to the base section 32 of the antenna 14.

Basically, as seen in FIGS. 7 to 11, the mounting bracket 16 includes a first end with an antenna attachment section 40, a middle section 42, and a second end with a vehicle attachment section 44. At the first end of the mounting bracket 16, the antenna attachment section 40 is fixed to the base section 32 of the antenna 14. The middle section 42 extends downwardly from the antenna attachment section 40 and connects with the vehicle attachment section 44. At the second end of the mounting bracket 16, the vehicle attachment section 44 extends from the middle section 42 in a radial direction with respect to a center longitudinal axis of the elongated mast section 30 as viewed along the center longitudinal axis of the elongated mast section 30. Preferably, the antenna attachment section 40, the middle section 42 and the vehicle attachment section 44 are integrally formed as a one-piece, unitary member from a metallic sheet material that is stamped to the desired configuration as shown. The mounting bracket 16 is configured and dimensioned so that the antenna 14 can be easily installed into the opening 24 defined by the front fender 26 of the vehicle 10 as explained below.

Figure 5:
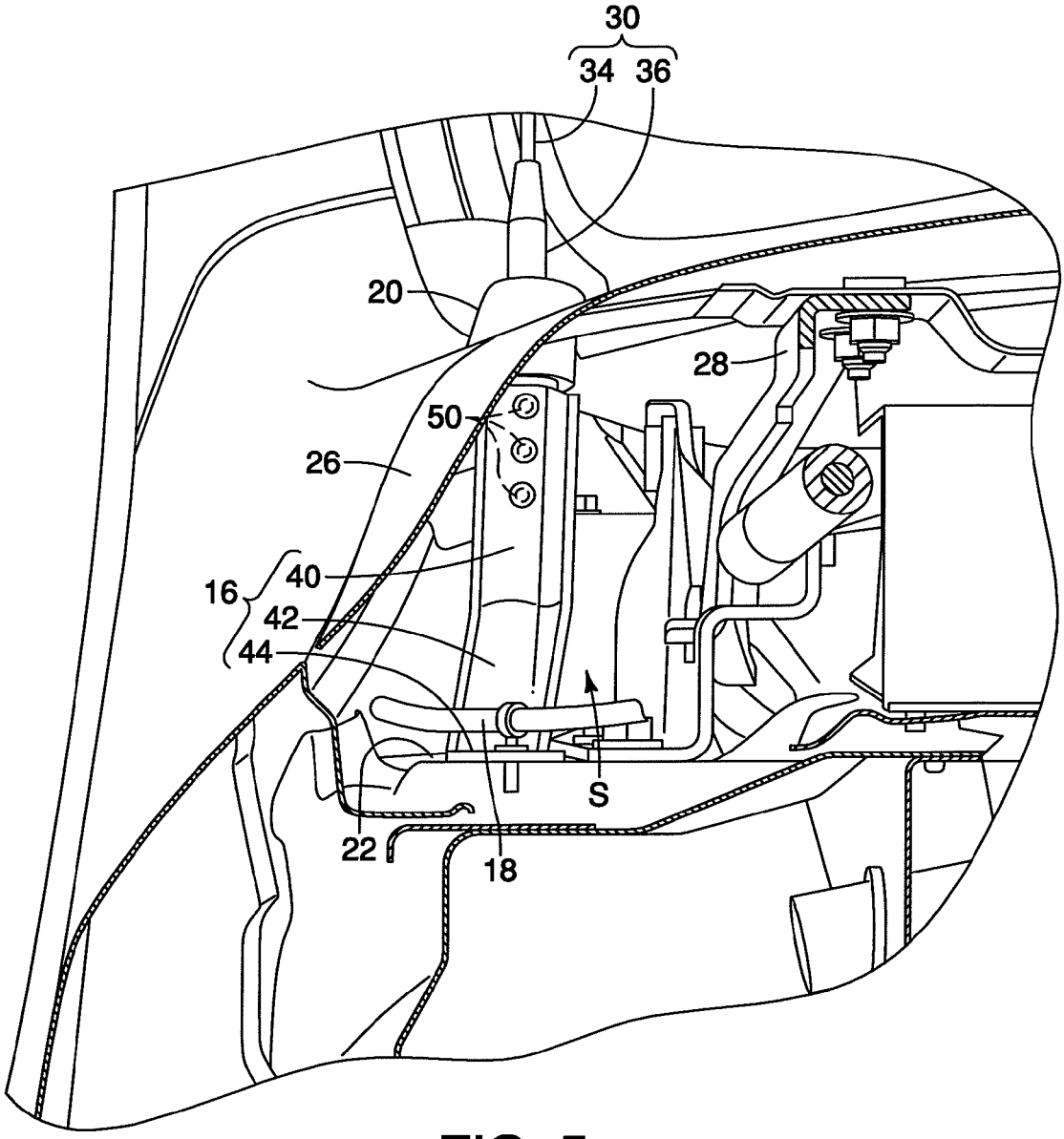
FIG. 5 is a cross sectional view of the vehicle illustrated in FIG. 1 as taken along a transverse section that is looking towards the rear of the vehicle to show the vehicle antenna assembly mounted to the vehicle body.

As seen in FIGS. 5 and 6, the antenna attachment section 40 is non-planar section that wraps partially around the base section 32 of the antenna 14. In particular, the antenna attachment section 40 has a generally curved cross sectional profile that wraps about 180 degrees around the base section 32 of the antenna 14. Preferably, the outer molded part of the base section 32 of the antenna 14 is molded onto the antenna attachment section 40 of the mounting bracket 16. In particular, the antenna attachment section 40 defines three attachment holes 50 (see FIGS. 5 and 8) in which the material of the outer molded part of the base section 32 of the antenna 14 extends into the attachment holes 50 and overlies the area surrounding the attachment holes 50 to secure the antenna attachment section 40 to the base section 32 of the antenna 14. Alternatively, the antenna attachment section 40 can be attached to the base section 32 of the antenna 14 in a variety of other ways as needed and/or desired. The antenna attachment section 40 extends upwardly at an obtuse angle from the middle section 42 such that the base section 32 of the antenna 14 extends vertically (i.e., in a vertical direction or in a slightly tilted direction from the vertical direction).

The middle section 42 of the mounting bracket 16 is also a non-planar section. In particular, the middle section 42 of the mounting bracket 16 has a generally curved cross sectional profile. The middle section 42 extends downwardly at an obtuse angle from the antenna attachment section 40 to the vehicle attachment section 44. Thus, the middle section 42 is connected to the vehicle attachment section 44 to form a fulcrum point 52 between the middle section 42 and the vehicle attachment section 44. While the fulcrum point 52 is located between the middle section 42 and the vehicle attachment section 44, it will be apparent to those skilled in the art that the fulcrum point 52 can located as part of the middle section 42 or the vehicle attachment section 44 depending on the structure of the vehicle to which the mounting bracket 16 is attached.

Figure 14:
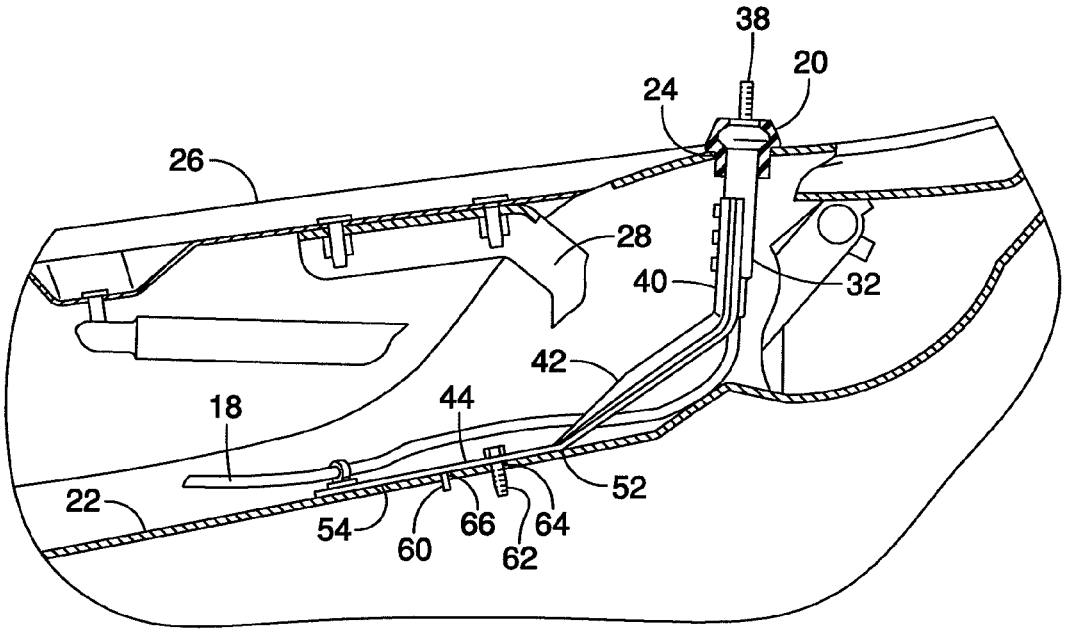
FIG. 14 is a cross sectional view of the vehicle antenna assembly in the installed position into the vehicle by the first installation method.
Figure 17:
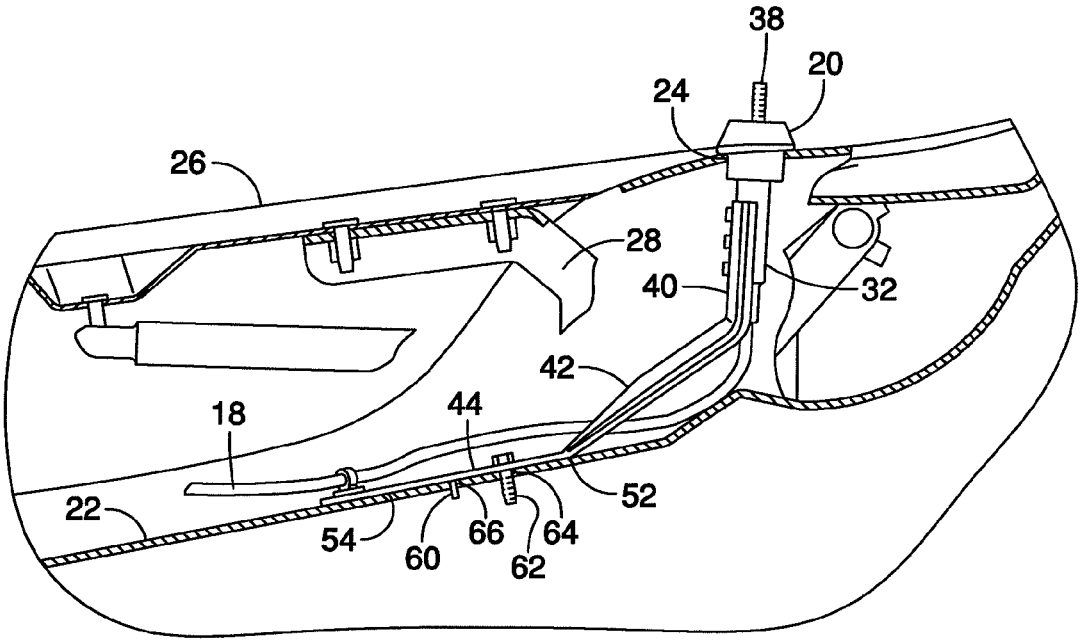
FIG. 17 is a cross sectional view of the vehicle antenna assembly in the installed position into the vehicle by the second installation method.

The vehicle attachment section 44 of the mounting bracket 16 has a vehicle facing support surface 54 defining a vehicle attachment plane that mates with a generally flat surface of the hood ledge 22 as seen in FIGS. 14 and 17. The vehicle facing support surface 54 of the vehicle attachment section 44 is generally planar surface. The vehicle facing support surface 54 has a fastening part 56 that is configured and arranged to be fastened to the hood ledge 22 of the vehicle 10 such that the base section 32 of the antenna 14 is supported by the antenna attachment section 40 above the vehicle attachment plane.

Figure 11:
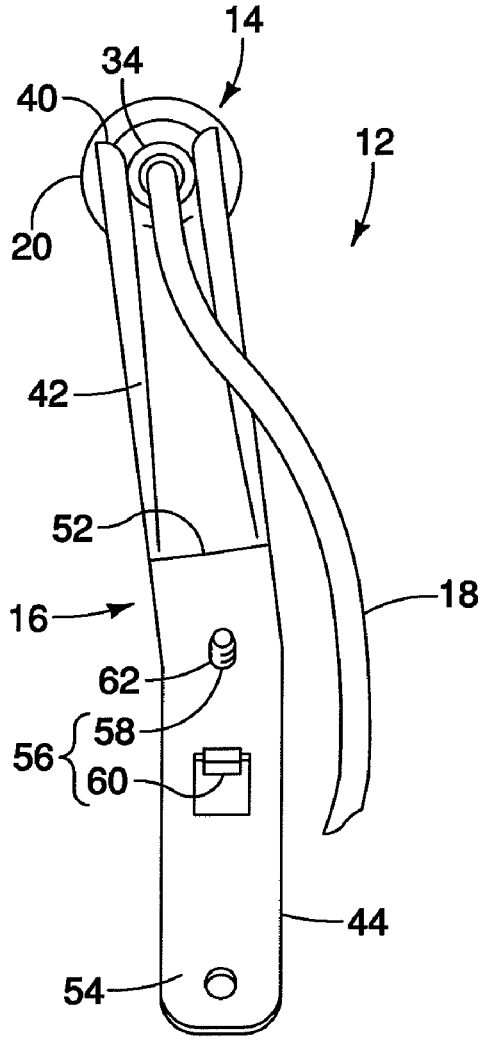
FIG. 11 is a bottom plan view of the vehicle antenna assembly illustrated in FIGS. 7 to 10.

The fastening part 56 of the vehicle attachment section 44 includes a mounting aperture 58 and a locating tab 60 as seen in FIG. 11. The mounting aperture 58 threadedly receives a threaded fastener 62. The threaded fastener 62 is threaded into a mounting hole 64 formed in the hood ledge 22 of the vehicle 10 to securely attach the mounting bracket 16 of the vehicle antenna assembly 12 to the hood ledge 22 of the vehicle 10 as seen in FIGS. 14 and 17. The locating tab 60 extends downwardly from the vehicle facing support surface 54 of the vehicle attachment section 44. The locating tab 60 engages an opening 66 in the hood ledge 22 of the vehicle 10 during installation of the vehicle antenna assembly 12 as seen in FIGS. 14 and 17. In particular, the locating tab 60 engages the opening 66 in the hood ledge 22 of the vehicle 10 to hold the mounting bracket 16 of the vehicle antenna assembly 12 in place on the hood ledge 22 of the vehicle 10 until the threaded fastener 62 is installed into the mounting hole 64 formed in the hood ledge 22 of the vehicle 10.

Figure 12:
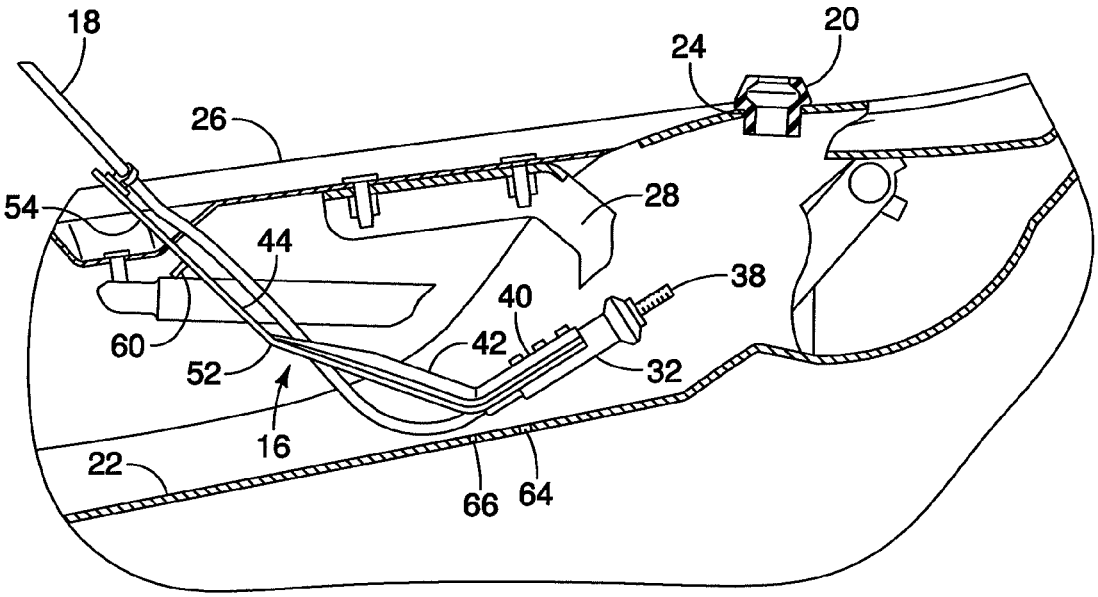
FIG. 12 is a cross sectional view, of the vehicle antenna assembly being initially installed into the vehicle illustrated in FIG. 1 in accordance with a first installation method.
Figure 13:
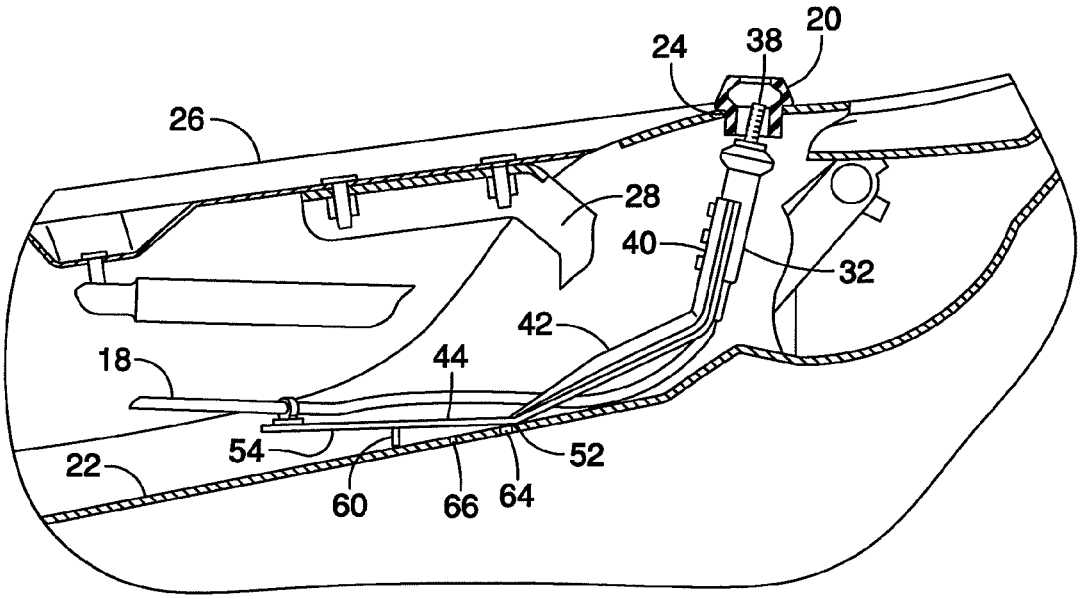
FIG. 13 is a cross sectional view of the vehicle antenna assembly in an intermediate installation position that occurs after the initial installation position illustrated in FIG. 12.
Figure 15:
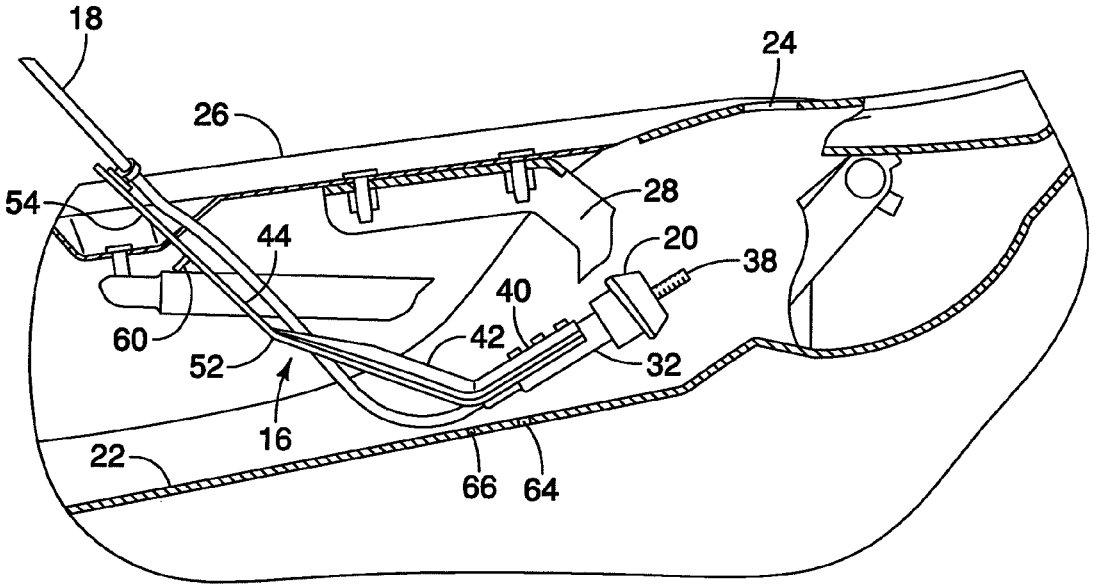
FIG. 15 is a cross sectional view of the vehicle antenna assembly being initially installed into the vehicle illustrated in FIG. 1 in accordance with a second installation method.
Figure 16:
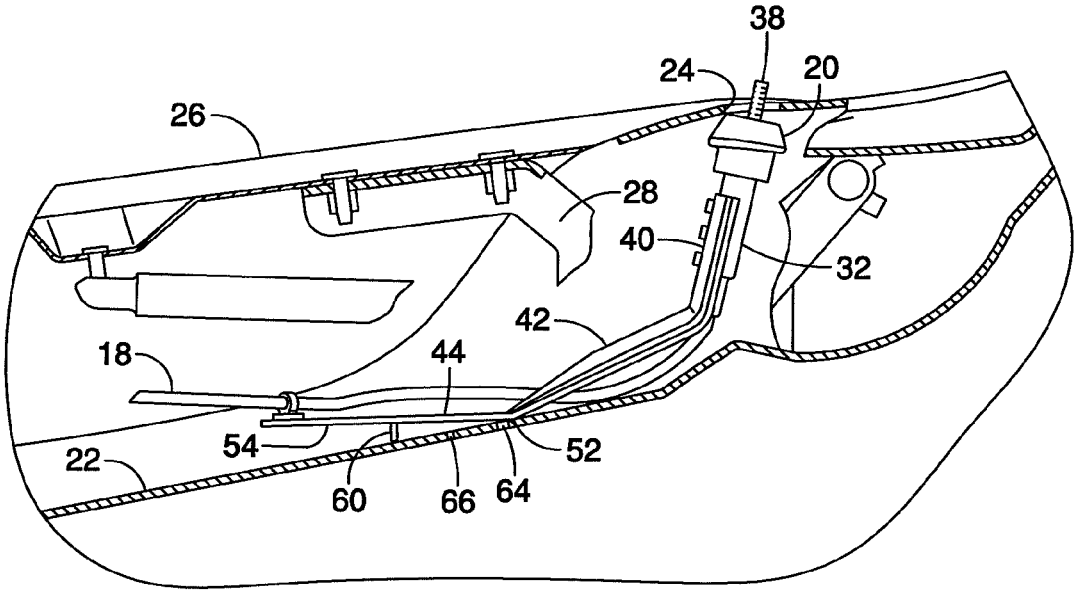
FIG. 16 is a cross sectional view of the vehicle antenna assembly in an intermediate installation position that occurs after the initial installation position illustrated in FIG. 15.

A first installation method for installing the vehicle antenna assembly 12 to the hood ledge 22 of the vehicle 10 is illustrated in FIGS. 12 to 14. A second installation method for installing the vehicle antenna assembly 12 to the hood ledge 22 of the vehicle 10 is illustrated in FIGS. 15 to 17. In either installation method, the antenna attachment section 40 (e.g., a first end) of the mounting bracket 16 is attached to the base section 32 of the antenna 14 prior to attaching the elongated mast section 30 to the base section 32.

Next, in either installation method, an installer positions the base section 32 of the antenna 14 to align with the opening 24 defined by the front fender 26 (e.g., a vehicle exterior body panel) of the vehicle 10. Now during these installation methods, the fulcrum point 52 of the mounting bracket 16 is engaged with a portion of the hood ledge 22 of the vehicle 10 such that the vehicle attachment section 44 (e.g., a second end) of the mounting bracket 16 is spaced from the vehicle 10. Then the installer pushes down on the vehicle attachment section 44 of the mounting bracket 16. By pushing down on (i.e., moving) the attachment section 44 (e.g., the second end) of the mounting bracket 16, the mounting bracket 16 pivots about the fulcrum point 52 to move the vehicle facing support surface 54 towards the hood ledge 22 of the vehicle 10, and to move the base section 32 of the antenna 14 into the opening 24 in the front fender 26 of the vehicle 10. This pivoting movement of the mounting bracket 16 pivots about the fulcrum point 52 forces the base section 32 of the antenna 14 further into the opening 24 in the front fender 26 (i.e., the vehicle exterior body panel).

In the case of the first installation method, the grommet 20 can be held in the opening 24 of the front fender 26 prior to the base section 32 of the antenna 14 being forced into the opening 24 of the front fender 26 as seen in FIGS. 12 to 14. Alternatively, in the case of the second installation method, the grommet 20 can be installed on the base section 32 of the antenna 14 prior to the base section 32 of the antenna 14 being forced into the opening 24 of the front fender 26 as seen in FIGS. 15 to 17.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Also as used herein to describe the above embodiment(s), the following directional terms "forward", "rearward", "above", "downward", "vertical", "horizontal", "below" and "transverse" as well as any other similar directional terms refer to those directions of a vehicle equipped with the present invention. Accordingly, these terms, as utilized to describe the present invention should be interpreted relative to a vehicle equipped with the present invention. The terms of degree such as "substantially", "about" and "approximately" as used herein mean a reasonable amount of deviation of the modified term such that the end result is not significantly changed.

While only selected embodiments have been chosen to illustrate the present invention, it will be apparent to those skilled in the art from this disclosure that various changes and modifications can be made herein without departing from the scope of the invention as defined in the appended claims. For example, the size, shape, location or orientation of the various components can be changed as needed and/or desired. Components that are shown directly connected or contacting each other can have intermediate structures disposed between them. The functions of one element can be performed by two, and vice versa. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the foregoing descriptions of the embodiments according to the present invention are provided for illustration only, and not for the purpose of limiting the invention as defined by the appended claims and their equivalents.

What is claimed is:

1. A vehicle antenna assembly comprising:

an antenna including an elongated mast section and a base section; and a mounting bracket including a first end with an antenna attachment section fixed to the base section of the antenna, a middle section extending from the antenna attachment section, and a second end with a vehicle attachment section extending non-moveably from the middle section, the mounting bracket defining a first surface and a second surface, the first surface extending from the first end to the second end, the first surface having a first portion defined on the antenna attachment section, a second portion defined on the middle section and a third portion defined on the vehicle attachment section, the second surface also extending from the first end to the second end on an opposite side of the mounting bracket from the first surface, a portion of the second surface defining a vehicle facing support surface extending along the vehicle attachment section which defines a vehicle attachment plane with the vehicle facing support surface having a fastening part configured and arranged to be fastened to a vehicle such that the base section of the antenna is supported by the antenna attachment section above the vehicle attachment plane, at least one of the middle section and the vehicle attachment section including a fulcrum point defined on the second surface arranged to engage a portion of the vehicle for pivoting the mounting bracket about the fulcrum point to move the vehicle facing support surface towards the vehicle, the middle section extending upwardly at a first obtuse angle from the vehicle attachment section, the first obtuse angle being measured between the third portion of the first surface and the second portion of the first surface, the antenna attachment section extending upwardly at a second obtuse angle from the middle section such that the base section of the antenna extends vertically, the second obtuse angle being measured between the second portion of the first surface and the first portion of the first surface.

2. The vehicle antenna assembly according to claim 1, wherein the fulcrum point is formed at an intersection between the middle section and the vehicle attachment section.

3. The vehicle antenna assembly according to claim 1, wherein the antenna attachment section, the middle section and the vehicle attachment section are integrally formed as a one-piece, unitary member from a metallic sheet material.

4. The vehicle antenna assembly according to claim 1, wherein the vehicle attachment section includes a locating tab extending downwardly from the vehicle facing support surface of the vehicle attachment section.

5. The vehicle antenna assembly according to claim 1, wherein the antenna attachment section is non-planar and wraps partially around the base section of the antenna such that the second surface contacts the base section of the antenna.

6. The vehicle antenna assembly according to claim 1, wherein the middle section is non-planar and the second portion of the first surface is defined proximate a central region thereof.

7. The vehicle antenna assembly according to claim 1, wherein the vehicle facing support surface of the vehicle attachment section is planar.

8. The vehicle antenna assembly according to claim 1, wherein the base section includes a removable grommet disposed about an upper end of the base section.

9. The vehicle antenna assembly according to claim 1, wherein the elongated mast section is removably attached to the base section.

10. The vehicle antenna assembly according to claim 9, wherein the outer molded part of the base section extends into at least one hole defined by the antenna attachment section.

11. A method of installing an antenna onto a vehicle comprising:

attaching a first end of a mounting bracket to a base section of the antenna, the mounting bracket having an antenna attachment section, a middle section and a vehicle attachment section, the base section of the antenna attaching to the antenna attachment section, the mounting bracket defining a first surface and a second surface on an opposite side of the mounting bracket from the first surface, the first surface extending along each of the antenna attachment section, the middle section and the vehicle attachment section, the first surface having a first portion defined on the antenna attachment section, a second portion defined on the middle section and a third portion defined on the vehicle attachment section, the middle section extending upwardly at a first obtuse angle from the vehicle attachment section, the first obtuse angle being measured between the third portion of the first surface and the second portion of the first surface, the antenna attachment section extending upwardly at a second obtuse angle from the middle section such that the base section of the antenna extends vertically, the second obtuse angle being measured between the second portion of the first surface and the first portion of the first surface;

positioning the base section to align with an opening defined by a vehicle exterior body panel;

engaging a fulcrum point of the mounting bracket against a portion of the vehicle such that a second end of the mounting bracket defined at a distal end of the vehicle attachment section, is spaced from the vehicle and the fulcrum point is located on the second surface of the mounting bracket;

moving the second end of the mounting bracket towards the vehicle to pivot the mounting bracket about the fulcrum point of the mounting bracket such that the first end of the mounting bracket forces the base section of the antenna further into the opening in the vehicle exterior body panel.

12. The method according to claim 11, further comprising:

holding a grommet in the opening in the vehicle exterior body panel prior to the base section of the antenna being forced into the opening in the vehicle exterior body panel.

13. The method according to claim 11, further comprising:

installing a grommet onto the base section of the antenna prior to the base section of the antenna being forced into the opening in the vehicle exterior body panel.

14. A vehicle and vehicle antenna assembly comprising:

a vehicle structure that includes a vehicle exterior body panel defining an antenna opening and a ledge extending under and spaced apart from the vehicle exterior body panel;

an antenna including an elongated mast section and a base section;

a mounting bracket including a first end with an antenna attachment section fixed to the base section of the antenna, a middle section extending downwardly from the antenna attachment section, and a second end with a vehicle attachment section extending non-moveably from the middle section in a radial direction with respect to a center longitudinal axis of the elongated mast section as viewed along the center longitudinal axis of the elongated mast section, the vehicle attachment section having a vehicle facing support surface defining a vehicle attachment plane with the vehicle facing support surface having a fastening part fastened to the ledge such that the base section of the antenna is supported by the antenna attachment section above the vehicle attachment plane with the elongated mast section extending through the antenna opening and above the vehicle exterior body panel, at least one of the middle section and the vehicle attachment section including a fulcrum point facing the ledge arranged to engage the ledge for pivoting the mounting bracket about the fulcrum point to move the vehicle facing support surface towards the vehicle and the elongated mast section upward through the antenna opening during installation.

15. A vehicle and vehicle antenna assembly according to claim 14, wherein the mounting bracket defines a first surface and a second surface, the first surface extending continuously from a first end to a second end of the mounting bracket, the first surface having a first portion defined on the antenna attachment section, a second portion defined on the middle section and a third portion defined on the vehicle attachment section, the second surface also extending from the first end to the second end on an opposite side of the mounting bracket from the first surface, a portion of the second surface defining the fulcrum point, and the middle section extending upwardly at a first obtuse angle from the vehicle attachment section, the first obtuse angle being measured between the third portion of the first surface and the second portion of the first surface, the antenna attachment section extending upwardly at a second obtuse angle from the middle section such that the base section of the antenna extends vertically, the second obtuse angle being measured between the second portion of the first surface and the first portion of the first surface.

16. A vehicle and vehicle antenna assembly according to claim 14, wherein the fulcrum point is formed at an intersection between the middle section and the vehicle attachment section.

17. A vehicle and vehicle antenna assembly according to claim 14, wherein the antenna attachment section, the middle section and the vehicle attachment section are integrally formed as a one-piece, unitary member from a metallic sheet material.

18. A vehicle and vehicle antenna assembly according to claim 14, wherein the vehicle exterior body panel extends over at least a portion of the fulcrum point with the fastening part of the vehicle attachment section fastened to the ledge and the antenna extending through the antenna opening.

19. A vehicle and vehicle antenna assembly according to claim 14, wherein the vehicle exterior body panel extends over the majority of the middle portion with the fastening part of the vehicle attachment section fastened to the ledge and the antenna extending through the antenna opening.

20. A vehicle and vehicle antenna assembly according to claim 14, wherein the vehicle structure further comprises a hood hinge supported to the ledge, the hood hinge being positioned on a first lateral side of the mounting bracket, with the vehicle exterior body panel extending above the mounting bracket and along a second lateral side of the mounting bracket that is opposite the first side with the fastening part of the vehicle attachment section fastened to the ledge and the antenna extending through the antenna opening.

* * * * *